US005799717A

United States Patent [19]

Aoshima et al.

[11] Patent Number: 5,799,717

[45] Date of Patent: Sep. 1, 1998

[54] COPPER ALLOY MOLD FOR CASTING ALUMINUM OR ALUMINUM ALLOY

[75] Inventors: Shoju Aoshima, Nagoya; Naokuni Muramatsu, Handa, both of Japan

[73] Assignees: Techno Coat Company, Ltd.; NGK Insulators, Ltd., both of Japan

[21] Appl. No.: 751,100

[22] Filed: Nov. 15, 1996

[30] Foreign Application Priority Data

Nov. 17, 1995 [JP] Japan ..... 7-299717

[51] Int. Cl.[6] ..... B28B 7/36

[52] U.S. Cl. ..... 164/271; 164/138; 249/114.1

[58] Field of Search ..... 164/138, 418, 164/271; 249/114.1, 115, 116

[56] References Cited

U.S. PATENT DOCUMENTS

| | | | |
|---|---|---|---|
| 3,524,956 | 8/1970 | Rocklin . | |
| 3,878,351 | 4/1975 | Rocklin | 219/69 |
| 3,969,601 | 7/1976 | Rocklin | 219/69 |
| 4,551,603 | 11/1985 | Rocklin | 219/76.13 |

FOREIGN PATENT DOCUMENTS

| | | |
|---|---|---|
| 400 683 | 12/1990 | European Pat. Off. . |
| 2-229643 | 9/1990 | Japan . |
| 4-258356 | 9/1992 | Japan . |
| 5-237593 | 9/1993 | Japan . |
| 1 439 789 | 5/1976 | United Kingdom . |

OTHER PUBLICATIONS

Patent Abstracts of Japan vol. 12, No. 61 (M-671), Feb. 24, 1988 & JP 62 207534 A (Mishima Kosan Co Ltd), Sep. 11 1987, abstract.

Patent Abstracts of Japan vol. 014, No. 262 (M-0981), Jun. 6, 1990 & JP 02 075447 A (Nomura Techno Res KK), Mar. 15, 1990, abstract.

Patent Abstracts of Japan vol. 013, No. 560 (M-906), Dec. 13, 1989 & JP 01 233047 A (Nomura Tokin:KK), Sep. 18, 1989, abstract.

Patent Abstracts of Japan vol. 018, No. 418 (M-1650), Aug. 5, 1994 & JP 06 126389 A (Mishima Kosan Co Ltd), May 10, 1994, abstract.

Patent Abstracts of Japan vol. 018, No. 352 (M-1631), Jul. 4, 1994 & JP 06 019352 A (Mishima Kosan Co Ltd), abstract.

Patent Abstracts of Japan vol. 95, No. 007 & JP 07 171661 A (Nippon Steel Corp), Jul., 11, 1995, abstract.

Patent Abstracts of Japan vol. vol. 006, No. 106 (M-213), May 10, 1983 & JP 58 029547 A (Nippon Kokan KK; Others: 01), Feb. 21, 1983, abstract.

Patent Abstracts of Japan vol. 018, No. 524 (M-1682), Oct. 4, 1994 & JP 06 182498 A (Mishima Kosan Co Ltd), Jul. 5, 1994, abstract.

Patent Abstracts of Japan vol. 005, No. 158 (M-091), Oct. 12, 1981 & JP 56 086655 A (Mitsubishi Heavy Ind Ltd), Jul. 14, 1981, abstract.

Patent Abstracts of Japan vol. 011, No. 157 (M-590), May 21, 1987 & JP 61 289948 A (Mitsubishi Heavy Ind Ltd), Dec. 19, 1986, abstract.

*Primary Examiner*—Kuang Y. Lin
*Attorney, Agent, or Firm*—Wall Marjama & Bilinski

[57] ABSTRACT

A mold for casting aluminum or aluminum alloy made of a copper alloy having a thermal conductivity of not less than 0.20 cal/s•cm°C. The mold cavity surface is locally or entirely formed with a coated layer. The coated layer may be either (i) a cermet layer including of at least one element selected from the group consisting of Co, Cu, Cr and Ni, or (ii) a Co—, Ni—, Cr —or Mo-based hard alloy layer. The copper alloy mold exhibits distinguished thermal conductivity and resistance to melt damages.

9 Claims, No Drawings

COPPER ALLOY MOLD FOR CASTING ALUMINUM OR ALUMINUM ALLOY

BACKGROUND OF THE INVENTION

1. Field of the Invention

The present invention relates to a copper alloy mold which can be suitably used for casting aluminum or aluminum alloy.

2. Description of Related Art

Conventionally, aluminum or aluminum alloy, which will be collectively referred to as "aluminum alloy" hereinafter, is cast in a mold which may be of high pressure type, low pressure type or gravity type. Such a mold is generally comprised of a hard steel, for example "SKD 61", mainly because steel has a high resistance to erosion by aluminum under the casting temperature, a high resistance to thermal impact cracks or heat cracks, and a high resistance to contact-wear of the mold which occurs when removing the cast alloy from the mold cavity. However, use of steel for the mold for casting aluminum alloy gives rise to problems that a relatively long time is required for each casting cycle due to a low thermal conductivity of steel and, hence, a low cooling rate of the mold, and further that the grain of the casted aluminum alloy becomes coarse due to the low cooling rate, with a result that the strength and ductility of the cast alloy deteriorate.

As a solution for these problems, it has been recently proposed to use a copper alloy mold having a superior thermal conductivity. However, as compared to steel, copper alloy has a higher solubility to aluminum alloy and tends to be readily eroded by aluminum alloy. Moreover, copper alloy is softer than steel and is thus difficult to machine and suffers from a relatively poor weldability which is a characteristic required for repairing the mold.

SUMMARY OF THE INVENTION

It is a primary object of the present invention to provide a copper alloy mold for casting aluminum alloy, which advantageously eliminates the above-mentioned problems of the prior art.

It is a specific object of the present invention to provide a copper alloy mold having a superior thermal conductivity and an improved resistance to melt-damages which may be caused as a result of erosion by aluminum alloy.

The present invention is based on a novel recognition reached by the inventors in the course of extensive investigations, as follows.

In order to improve the resistance to melt-damages of a copper alloy mold, one may consider that the surface of the mold should be coated by a material having an enriched hardness and a low affinity to aluminum alloy.

Thus, the inventors carried out extensive investigations to ascertain the suitability of various ceramics, cermets and non-ferrous alloys having an enriched hardness (hereinafter referred to as "hard alloys"), as a coating material for a copper alloy mold.

As a result, it has been found that a cermet comprising at least one element selected from the group consisting of Co, Cu, Cr and Ni, as well as a Co—, Ni—, Cr— or Mo-based hard alloy are particularly suitable as the coating material for a copper alloy mold.

Based on such recognition, the present invention provides a copper alloy mold for casting aluminum or aluminum alloy, wherein the mold has a thermal conductivity of not less than 0.20 cal/s•cm°C., and includes a mold cavity surface which is at least locally coated with a cermet layer comprising at least one element selected from the group consisting of Co, Cu, Cr and Ni, or with a Co—, Ni—, Cr— or Mo-based hard alloy layer.

Advantageously, the cermet layer comprises (i) at least one ceramic selected from the group consisting of carbides, nitrides, silicides, borides and oxides, and (ii) at least one element selected from the group consisting of Co, Cu, Cr and Ni.

In this instance, the cermet layer preferably comprises one of WC—Co cermet, $MOB_2$—Ni cermet and $Cr_3C_2$—Ni cermet.

The Mo-based alloy layer preferably comprises Co—Mo—Cr alloy.

The coated layer preferably has an arithmetic mean roughness Ra which is within a range of 0.1–200 μm.

Advantageously, the copper alloy according to the present invention consists essentially of:

Ni: 1.0–6.0 weight%,

Co: 0.1–0.6 weight%,

Be: 0.15–0.8 weight%,

Mg: 0.2–0.7 weight% and/or Al: 0.7–2.0 weight%, and

Cu: the balance.

As will become more apparent from the following description, the copper alloy mold for casting aluminum alloy according to the present invention exhibits a high cooling rate. It is thus possible to minimize the casting cycle time, and to produce cast aluminum alloy products having fine grain size, improved strength and improved ductility.

DESCRIPTION OF THE PREFERRED EMBODIMENTS

The present invention will now be explained with reference to practical embodiments.

Referring first of all to copper alloy as the basic material of the mold for casting aluminum alloy, it is required that the copper alloy has a thermal conductivity which is not less than 0.20 cal/s•cm°C. In other words, when the thermal conductivity of copper alloy is less than 0.20 cal/•cm°C., a sufficient thermal conductance of the mold is not achieved, thereby giving rise to the above-mentioned problems.

On the other hand, however, an excessively high thermal conductivity of copper alloy results in degraded weldability of the mold, a characteristic required for enabling repair of the mold. Therefore, it is preferred that the thermal conductivity of the copper alloy falls within a range of 0.20 to 60 cal/s•cm°C. Copper alloys satisfying such a thermal conductivity condition is disclosed, for example, in JIS C19500 (Cu—1.5Fe—0.8Co—0.69n—0.1P), JIS C19400 (Cu—2.4Fe—0.12Zn—0.04P), JIS C2300 (Cu—15Zn), C507 (Cu—2Sn—0.15P), and the like.

Also, it is highly preferred that, in addition to thermal conductivity, the mold has an adequate hardness in view of machinability and weldability. This requirement is met by a copper alloy which consists essentially of:

Ni: 1.0–6.0 weight%,

Co: 0.1–0.6 weight%,

Be: 0.15–0.8 weight%,

Mg: 0.2–0.7 weight% and/or Al: 0.7–2.0 weight%, and

Cu: the balance.

A copper alloy with this composition has a thermal conductivity of 0.25–0.55 cal/s•cm°C., and a Brinell hardness ($H_B$) within a range of 180–300. Thus, such copper alloy has well-balanced thermal conductivity and hardness, and is therefore optimum for use as a mold for casting aluminum alloy.

The grounds for determining the preferred ranges of the respective elements in the above-mentioned composition of copper alloy will be explained below.

●Ni: 1.0–6.0 weight%

Ni is added to improve the strength due to formation of NiBe compound. When the Ni content is less than 1.0 weight%, the desired improvement cannot be achieved. On the other hand, when the Ni content exceeds 6.0 weight%, the effect of improvement in strength is saturated, while thermal conductivity deteriorates and the melting temperature of the alloy increases thereby making it difficult to perform welding.

●Co: 0.1–0.6 weight%

Co is added to improve the strength due to formation of CoBe compound. When the Co content is less than 0.1 weight%, the desired improvement cannot be achieved. On the other hand, when the Co content exceeds 0.6 weight%, the alloy becomes brittle thereby degrading the hot-workability of the alloy.

●Be: 0.15–0.8 weight%

Be is coupled with Ni or Co to form a NiBe compound or a BeCo compound, thereby contributing to realize an improved strength of the alloy. When the Be content is less than 0.15 weight%, the desired improvement cannot be achieved. On the other hand, when the Be content exceeds 0.8 weight%, the strength of the alloy becomes excessively high and the cost of the alloy increases.

●Mg; 0.2–0.7 weight% and/or Al: 0.7–2.0 weight%

Mg is added to provide an improved ductility at high temperature. When the Mg content is less than 0.2 weight%, the desired ductility is not achieved. On the other hand, when the Mg content exceeds 0.7 weight%, the effect of improving the ductility deteriorates a satisfactory thermal conductivity is not achieved.

Al, in turn, is added to improve the strength due to formation of $Ni_3Al$ compound and to facilitate adjustment of thermal conductivity. When the Al content is less than 0.7 weight%, the thermal conductivity becomes excessively high. On the other hand, when the Al content exceeds 2.0 weight%, the thermal conductivity becomes excessively low.

According to the invention, by adding either one or both of Mg and Al within the above-mentioned ranges, it is possible readily to achieve the desired thermal conductivity of 0.25–0.55 cal/s•cm°C.

The above-mentioned copper alloy is a precipitation-hardened alloy, and it is thus necessary to carry out a two-step heat treatment, i.e., solution treatment at a temperature preferably within a range of 850–1,000° C., and aging treatment at a temperature preferably within a range of 400–500° C.

With the exception of the above-mentioned two-step heat treatment, the copper alloy for the mold according to the invention can be manufactured essentially in the same manner as an ordinary copper alloy. Thus, it is readily possible to realize a copper alloy mold having a thermal conductivity of 0.25–0.55 cal/s•cm°C., and a Brinell hardness ($H_B$) within a range of 180–300.

In the next place, explanation will be made of the coated material on the surface of the mold which is comprised of the above-mentioned copper alloy.

As mentioned above, the coating on the surface of the mold is preferably comprised of (i) a cermet layer comprising at least one element selected from the group consisting of Co, Cu, Cr and Ni, or (ii) a Co—, Ni—, Cr— or Mo-based hard alloy layer. By a thin coating of such cermet layer or hard alloy layer on the surface of the mold, according to the present invention, it is possible to improve the resistance to melt-damages of the mold without degrading the thermal conductivity of the copper alloy.

Co, Cr and Ni components are required for the coating material because they have low reactivity with Al alloy and contribute as binders by alloying with copper alloy to effectively improve the bonding between the copper alloy of the mold and the coating thereon.

The cermet layer preferably comprises WC-Co cermet, $MoB_2$—Ni cermet or $Cr_3C_2$—Ni cermet. In these cermets, the metal content is preferably within a range of 1–49 weight%.

Also, the hard alloy layer on the surface of the mold preferably comprises a Co—Mo—Cr alloy consisting essentially of Co: 50–65 weight%, Mo: 25–30weight% and Cr: 5–25 weight%.

It is preferred that the above-mentioned coated layer has a thickness within a range of 0.1–3,000 μm, more preferably within a range of 5–100 μm. When the thickness is less than 0.1 μm, a satisfactory resistance to melt-damages cannot be achieved. On the other hand, when the thickness exceeds 3,000 μm, not only the bonding of the coated layer to the mold, but also the thermal conductivity of the mold deteriorate.

It is also preferred that the coated layer has an arithmetic mean roughness Ra within a range of 0.1–200 μm, more preferably within a range of 5–20 μm The roughness Ra of less than 0.1 μm is substantially the same as that of the mold surface, whereby it becomes difficult to achieve an improved bonding of the coated layer with the mold. On the other hand, when the roughness Ra exceeds 200 μm, the surface of the mold may be locally exposed and the bonding of primers cannot be further improved.

The process for forming the coated layer is not limited to a particular process, and any conventional process may be used, for example, flame spraying, plating, cladding by welding, and the like. However, a particularly suitable process is electro-spark deposition as fully disclosed in JP-A-6-269936 and JP-A-6-269939, the disclosure of which is herein incorporated by reference.

The electro-spark deposition process is not limited in terms of the dimension of the mold, allows a local coating of the mold, and has no dead point unlike the spraying process or the like, which is masked and cannot be coated. Because the electro-spark deposition process can be carried out under a normal temperature condition with a minimized heat input, it is possible to suppress softening of the copper alloy which would be caused when the copper alloy is exposed to high temperatures for a long time. Moreover, the electro-spark deposition process makes it possible readily to change or adjust the thickness and/or surface roughness of the coated layer. Thus, by adjusting the surface roughness of the coated layer, it becomes possible for the primer to effectively permeate into the uneven surface thereby achieving a stable and satisfactory bonding.

EXAMPLES

Test-pieces of copper alloy rod were prepared to have a diameter of 20 mm and a length of 150 mm, and having different compositions shown in Table 1. The surface of each test-piece was formed with a coated layer by the above-mentioned electro-spark deposition process, having various compositions also shown in Table 1. These test-pieces were immersed in aluminum bath at a temperature of approximately 690° C., for seven minutes in which the bath was maintained agitated. The test-pieces were then removed from the bath, to investigate the reactivity with aluminum, hence, the resistance to melt-damages. As for the cooling characteristic, mold members formed with coated layer shown in Table 1 were partially inserted into the mold which is designed to simultaneously produce four casted aluminum alloy products, and the microstructures (DAS: dendrite arm spacing) of the casted products were evaluated. The casting cycle time was also measured. The results thus obtained are shown in Table 1.

TABLE 1

| No. | Composition of copper alloy (mass %) | Thermal conductivity (cal/s · cm · °C.) | Hardness ($H_B$) | Composition of coated layer (mass %) | Hardness of coated layer (MHv) | Thickness (μm) | Surface roughness Ra (μm) | Resistance to melt-damages | DAS (μm) | Cycle time (min.) | Remarks |
|---|---|---|---|---|---|---|---|---|---|---|---|
| 1 | Cu-4.SNi-0.4Co-0.5Be-1.5A1 | 0.29 | 240 | WC-10Co | 2000 | 50 | 14 | ○ | 32 | 3 | Sample of the invention |
| 2 | Cu-4.5Ni-0.4Co 0.5Be-1.5Al | 0.29 | | WC-10Co | 2000 | 0.05 | 1 | X | Not evaluated | | Comparative sample |
| 3 | Cu-4.5Ni-0.4Co-0.5Be-1.5Al | 0.29 | | WC-10Co | 2000 | 4000 | 230 | ○ | 78 | 4 | Comparative sample |
| 4 | Cu-1.5Ni-0.5Co-0.2Be-0.5Mg | 0.52 | 202 | Co-29Mo-18Cr | 1200 | 30 | 20 | ○ | 35 | 3 | Sample of the invention |
| 5 | Cu-1.5N1-0.5Co-0.2Be-0.5Mg | 0.52 | | $MoB_2$-12Ni | 2200 | 1400 | 140 | ○ | 33 | 3 | Sample of the invention |
| 6 | Cu-4.5Ni-0.4Co-0.5Be-1.5Al | 0.29 | 240 | $Cr_3C_2$-13Ni | 1800 | 40 | 7 | ○ | 35 | 3 | Sample of the invention |
| 7 | Cu-7Ni-0.4Co-0.6Be-3.0Al | 0.15 | 260 | WC-10Co | 2000 | 50 | 17 | ○ | 68 | 4 | Comparative sample |
| 8 | Cu-0.9Ni-0.3Co-0.1Be-0.1Mg | 0.68 | 170 | WC-10Co | 2000 | Not evaluated/coating impossible | | | | | Comparative sample |
| 9 | Cu-4.5N1-0.4Co-0.5Be-1.5Al | 0.29 | 240 | Hard Cr-plating | 130 | 200 | 5 | X | Not evaluated | | Prior art |
| 10 | Cu-1.5Ni-0.5Co-0.2Be-0.5Mg | 0.52 | 202 | Non-electrolytic Ni-plating | 120 | 200 | 5 | X | Not evaluated | | Prior art |
| 11 | Cu-1.5Ni-0.5Co-0.2Be-0.5Mg | 0.52 | 202 | TiN (CVD) | 1800 | 15 | 2 | X | Not evaluated | | Prior art |
| 12 | SKD 61 | 0.09 | 370 | — | — | — | — | A | 74 | 4.5 | Prior art |

Resistance to melt-damages
○: no dimensional change
Δ: dimensional decrease less than 5%
X: dimensional decrease not less than 5%
DAS: dendrite arm spacing (μm) measured by microscope inspection
Cycle time: actual time from pouring of molten Al alloy into the mold to completion of solidification As can be clearly seen from Table 1, the mold comprising a coated layer according to the invention exhibits distinguished resistance to melt-damages and casting cycle time.

It will be appreciated from the foregoing description that the present invention provides an improved copper alloy mold for casting aluminum alloy, which is featured by a high cooling rate making it possible to minimize the casting cycle time and to produce cast aluminum alloy products having fine grain size, improved strength and improved ductility. It is possible readily to control the temperature of selected portion of the mold, so as to eliminate or mitigate occurrence of casting defects. Moreover, the copper alloy mold according to the present invention is hardly eroded by molten aluminum alloy and thus has a high resistance to melt-damages.

While the present invention has been described above with reference to specific embodiments, it is of course understood that various modifications and/or alterations may be made without departing from the scope of the invention as defined by the appended claims.

What is claimed is:

1. A copper alloy mold for casting aluminum or aluminum alloy, said mold having a thermal conductivity of not less than 0.20. cal/s•cm°C., and including a mold cavity surface which is at least locally coated with a cermet layer comprising at least one element selected from the group consisting of Co, Cu, Cr and Ni.

2. The mold according to claim 1, wherein said cermet layer comprises (i) at least one ceramic selected from the group consisting of carbides, nitrides, silicides, borides and oxides, and (ii) at least one element selected from the group consisting of Co, Cu, Cr and Ni.

3. The mold according to claim 2, wherein said cermet layer comprises one of WC—Co cermet, $MOB_2$—Ni cermet and $Cr_3C_2$—Ni cermet.

4. The mold according to claim 1, wherein said coated layer has an arithmetic mean roughness Ra within a range of 0.1–200 μm.

5. The mold according to claim 1, wherein said copper alloy consists essentially of:

Ni: 1.0–6.0 weight%,

Co: 0.1–0.6 weight%,

Be: 0.15–0.8 weight%, at least one of Mg: 0.2–0.7 weight% and Al: 0.7–2.0 weight%, and Cu: the balance.

6. A copper alloy mold for casting aluminum or aluminum alloy, said mold having a thermal conductivity of not less than 0.20 cal/s•cm°C., and including a mold cavity surface which is at least locally coated with a layer comprising at least one member selected from the group consisting of a Co—, Ni—, Cr— or Mo-based hard alloy layer.

7. The mold according to claim 6 wherein said Mo-based alloy layer comprises Co—Mo—Cr alloy.

8. The mold according to claim 6, wherein said coated layer has an arithmetic mean roughness Ra within a range of 0.1–200μm.

9.The mold according to claim 6, wherein said copper alloy consists essentially of:

Ni: 1.0–6.0 weight %,

Co: 0.1–0.6 weight%,

Be: 0.15–0.8 weight%, at least one of Mg: 0.2–0.7 weight % and Al: 0.7–2.0 weight %, and Cu: the balance.

* * * * *